US010236597B2

(12) United States Patent
Meyer

(10) Patent No.: US 10,236,597 B2
(45) Date of Patent: Mar. 19, 2019

(54) SPRING TERMINAL CONTACT FOR CONTACT-CONNECTION OF ELECTRICAL CONDUCTORS, CONDUCTOR CONNECTION TERMINAL AND METHOD FOR PRODUCING A SPRING TERMINAL CONTACT

(71) Applicant: WAGO Verwaltungsgesellschaft mbH, Minden (DE)

(72) Inventor: Michael Meyer, Wiedensahl (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/812,145

(22) Filed: Nov. 14, 2017

(65) Prior Publication Data

US 2018/0145428 A1 May 24, 2018

(30) Foreign Application Priority Data

Nov. 18, 2016 (DE) ..... 10 2016 122 238

(51) Int. Cl.
*H01R 4/48* (2006.01)
*H01R 9/24* (2006.01)
(Continued)

(52) U.S. Cl.
CPC ..... *H01R 4/4809* (2013.01); *H01R 4/4836* (2013.01); *H01R 4/4845* (2013.01);
(Continued)

(58) Field of Classification Search
CPC ..... H01R 4/48; H01R 4/4809; H01R 4/4818; H01R 4/4836; H01R 4/4845; H01R 11/01; H01R 9/2416; H01R 12/515
See application file for complete search history.

(56) References Cited

U.S. PATENT DOCUMENTS 7,896,686 B2 * 3/2011 Hoppe ..... H01R 4/4827 439/441
8,771,027 B2 * 7/2014 Zhang ..... H01R 4/48 439/835

(Continued)

FOREIGN PATENT DOCUMENTS

WO WO 2014/124961 A1 8/2014

*Primary Examiner* — James Harvey
*Assistant Examiner* — Oscar C Jimenez
(74) *Attorney, Agent, or Firm* — Muncy, Geissler, Olds & Lowe, P.C.

(57) ABSTRACT

A spring terminal contact for contact-connection of electrical conductors to at least one busbar and at least one clamping spring, which has a resting limb, a spring bend adjoining the resting limb and a clamping limb adjoining the spring bend. The clamping limb has a clamping section at the free end, and frame parts extend away from the busbar, each frame part having two side webs spaced apart from one another and the side webs having transverse webs connecting to one another and a conductor passage opening formed by the side webs and the transverse webs. The at least one clamping spring is secured to the at least one busbar by the resting limb of the clamping spring resting on a transverse web and/or a holding element of the busbar such that the clamping section acts under the spring force of the clamping spring in the direction of the busbar.

21 Claims, 7 Drawing Sheets

(51) Int. Cl.
*H01R 11/01* (2006.01)
*H01R 12/51* (2011.01)
*H01R 101/00* (2006.01)

(52) U.S. Cl.
CPC ..... *H01R 11/01* (2013.01); *H01R 9/2416* (2013.01); *H01R 12/515* (2013.01); *H01R 2101/00* (2013.01)

(56) References Cited

U.S. PATENT DOCUMENTS

| | | | | |
|---|---|---|---|---|
| 9,831,568 | B2 * | 11/2017 | Giefers ..... | H01R 4/4809 |
| 2015/0372402 | A1 | 12/2015 | Köllmann et al. | |
| 2015/0380837 | A1 * | 12/2015 | Kollmann ..... | H01R 4/4836<br>439/721 |
| 2016/0352028 | A1 * | 12/2016 | Meyer ..... | H01R 4/4836 |
| 2017/0229792 | A1 * | 8/2017 | Wu ..... | H01R 4/4818 |

* cited by examiner

SPRING TERMINAL CONTACT FOR CONTACT-CONNECTION OF ELECTRICAL CONDUCTORS, CONDUCTOR CONNECTION TERMINAL AND METHOD FOR PRODUCING A SPRING TERMINAL CONTACT

This nonprovisional application claims priority under 35 U.S.C. § 119(a) to German Patent Application No. 10 2016 122 238.0, which was filed in Germany on Nov. 18, 2016, and which is herein incorporated by reference.

BACKGROUND OF THE INVENTION

Field of the Invention

The invention relates to a spring terminal contact for contact-connection of electrical conductors to at least one busbar and at least one clamping spring, which has a resting limb, a spring bend adjoining the resting limb and a clamping limb adjoining the spring bend, said clamping limb having a clamping section at the free end, and to one or more frame parts extending away from the busbar, each frame part having two side webs spaced apart from one another and the side webs having transverse webs connecting to one another and a conductor passage opening formed by the side webs and the transverse webs, wherein the at least one clamping spring is secured to the at least one busbar by the resting limb of the clamping spring resting on a transverse web and/or a holding element of the busbar in such a way that the clamping section acts under the spring force of the clamping spring in the direction of the busbar, with the result that a clamping point for firmly clamping the electrical conductor is formed between the clamping section and the busbar. The invention relates further to a conductor connection terminal formed with a spring terminal contact of this kind and to a method for producing a spring terminal contact of this kind.

Description of the Background Art

Spring terminal contacts of this kind are used, for example, in conductor connection terminals, specifically in connecting terminals, in particular in terminal boxes, for electrically conductively connecting a plurality of electrical conductors to one another. Spring terminal contacts of this kind can also be used, for example, in plug-type printed circuit board connectors, other plug-type connectors, terminal strips and other electrical devices. WO 2014/124961 A1 discloses a spring terminal contact and a connecting terminal.

SUMMARY OF THE INVENTION

It is therefore an object of the present invention to provide an electrical contact-connection to the busbar, in particular for electrical conductors in the form of litz-wire conductors. For a spring terminal contact that achieves the object, a method for producing said spring terminal contact is also to be specified.

In an exemplary embodiment, the spring terminal contact has at least one integrally formed wing present on at least one of the side webs. The electrical contact-connection of a litz-wire conductor to the busbar can be significantly improved by means of at least one wing of this kind or by a plurality of wings of this kind, since the individual litz wires have a defined lateral resting surface on the busbar due to the wing and can therefore rest better there.

It has been determined in accordance with the invention that, in the case of a busbar having one or more frame parts arranged thereon, said frame parts having a conductor passage opening delimited by side webs and transverse webs, in addition to the resting surface on the busbar that is actually provided for electrical contact-connection, the side webs can also be used to improve the electrical contact-connection. Forming at least one wing on at least one of the side webs creates, as explained, an improved lateral resting surface for the litz wires, with the result that this can achieve a significant improvement in the electrical contact-connection. In addition, a particularly compact spring terminal contact for a connecting terminal having improved electrical contact-connection can be provided.

The spring terminal contact according to the invention is therefore particularly suitable for transferring relatively high currents and accordingly also for electrical conductors having a relatively large cross section, for example for conductors up to 6 $mm^2$.

As mentioned, in the spring terminal contact according to the invention, a clamping point for firmly clamping the electrical conductor is formed between the clamping section and the busbar. In this case, the clamping point be formed directly between the clamping section and the busbar, or indirectly, for example by a further component being arranged in the force of flux between the clamping section and the busbar, for example an additional piece of sheet metal. The at least one wing can be arranged, in particular, spaced apart from the clamping point on the spring terminal contact.

In accordance with an embodiment of the invention, there is provision for integrally formed wings to be present on the two side webs of a frame part. In this way, the inventive, advantageous effect of improving the electrical contact-connection can be further increased.

In accordance with an embodiment of the invention, there is provision for the wings of a frame part to be arranged substantially symmetrically to one another. This can further improve the electrical contact-connection of litz-wire conductors.

In accordance with an embodiment of the invention, there is provision for the at least one wing to point in the direction of a conductor receiving space of the spring terminal contact, said conductor receiving space being formed behind the conductor passage opening in the conductor insertion direction. The at least one wing can therefore be arranged in the conductor passage opening approximately obliquely (at an angle) to the insertion direction of an electrical conductor. If wings are present on both side webs, they can run onto one another, for example, in a funnel-shaped manner, with the result that an electrical conductor inserted into the conductor passage opening opens into a receiving space between the wings that tapers in the conductor insertion direction. In this way, the litz wires of the electrical conductor are lightly pressed together a result of the funnel-shaped arrangement of the wings, which further improves the electrical contact-connection.

In accordance with an embodiment of the invention, there is provision for the at least one wing to be configured as a material region that is angled (bent) with respect to the surface of the side web. This allows simple and efficient manufacture of the spring terminal contact already described above.

In accordance with an embodiment of the invention, there is provision for the at least one wing to extend along the side web over at least two thirds of the distance between the transverse webs of the frame part. This can further improve the electrical contact-connection of litz-wire conductors, since a relatively large lateral resting surface is provided on the wing for the litz wires.

A clamping point for electrically connecting the electrical conductor is formed by the clamping section of the clamping spring and the busbar. Depending on the embodiment of the spring terminal contact, said clamping point can be formed in front of or behind the frame part, in the insertion direction of the electrical conductor into the conductor passage opening, or in the frame part. If the clamping point is arranged behind the frame part or at least behind the region in which the wing is formed on the frame part, a lead-in chamfer for the electrical conductor to be inserted can advantageously be formed by the at least one wing. This facilitates the insertion of the electrical conductor into the spring terminal contact or into the frame part and to the clamping point. However, even in another arrangement such that the clamping point is arranged in the conductor insertion direction in front of the frame part or the region in which the wing is formed on the frame part, the at least one wing can serve as an insertion aid for the electrical conductor to be inserted.

The angle between the busbar plane on which the clamping point is formed and the frame parts can advantageously be in the range of from 60 degrees to 120 degrees. In accordance with one advantageous development of the invention, there is provision for at least one of the frame parts to be arranged substantially at a right angle to the busbar. This allows simple insertion of the electrical conductor into the conductor passage opening in connection with good electrical contact-connection of the electrical conductor to the busbar.

In accordance with an embodiment of the invention, there is provision for at least one of the frame parts to be formed integrally with the busbar. In this way, the structural unit of the busbar with the frame part or the frame parts can be produced simply and cost-effectively. The busbar having the frame part or the frame parts arranged thereon and the wing or the wings can be produced, for example, integrally from a metal part, for example by a stamping and bending process. To this end, in order to form side webs and a transverse web, conductor passage openings can be stamped out of a busbar sheet and, before or after the step of stamping out the side webs together with the transverse web connecting same, that is to say the frame parts, are bent away from a clamping contact face of the busbar at an acute or oblique angle, for example an angle in the range of from 60 degrees to 120 degrees.

In accordance with an embodiment of the invention, there is provision for at least one of the frame parts to be configured as a frame element that is separate from the busbar and for the separate frame element to be hooked into the busbar. Here, the frame element can be held on the busbar by the force of the clamping springs acting between the transverse web and the frame part or the frame parts of the frame element and the busbar by virtue of the fact that the frame element engages under the frame element, for example. To this end, holding elements in the form of holding lugs can be provided on the busbar, transverse webs of the frame element engaging under said holding elements. It is also possible for the busbar to have latching openings or latching recesses, into which the latching fingers of the frame element engage, in order to releasably connect the frame element to the busbar. In this way, a particularly flexible design of a spring terminal contact is possible.

In accordance with an embodiment of the invention, there is provision for the clamping section to be turned away or bent from the section of the clamping limb adjoining the spring bend in the direction of the busbar. This can improve the secure clamping of an electrical conductor by the clamping spring and at the same time ensure that the electrical conductor can be connected to the clamping point without prior actuation of the clamping spring.

In accordance with an embodiment of the invention, there is provision for adjacent frame parts to have an intermediate space between two spaced-apart side webs of frame parts arranged next to one another. If an actuation element is provided for opening the clamping point, it can protrude into the intermediate space between two frame parts, with the result that a compact conductor connection terminal with lever actuation can be realized.

In accordance with an embodiment of the invention, there is provision for the clamping section to have a smaller width than the other section of the clamping limb. As a result, the at least one region of the section of the clamping limb that is wider with respect to the clamping section and that protrudes laterally relative to the clamping section as an actuation section for opening a clamping point for an electrical conductor, said clamping point being formed between the clamping section of the clamping spring and the busbar, can be opened using an actuation element that interacts with the actuation section and protrudes into the intermediate space between two frame parts.

In accordance with an embodiment of the invention, there is provision for at least one region of the section of the clamping limb that is wider with respect to the clamping section and that protrudes laterally relative to the clamping section to be provided as an actuation section for opening a clamping point for an electrical conductor, said clamping point being formed between the clamping section of the clamping spring and the busbar, by way of an actuation element that interacts with the actuation section. This allows convenient actuation of the clamping spring for opening and closing the clamping point.

The object mentioned at the beginning is further achieved by a conductor connection terminal for electrical conductors, having an isolating material housing and having at least one spring terminal contact of the type mentioned above. This can also realize the advantages mentioned above. The conductor connection terminal can be configured, for example, as a connecting terminal. The conductor connection terminal can have an actuation element for opening the clamping point, said actuation element interacting with the actuation section. The actuation element can protrude into the intermediate space between two frame parts, with the result that a compact conductor connection terminal with lever actuation can be realized, The object mentioned at the beginning is further achieved by a method for producing a spring terminal contact of the type mentioned above, having, for example, the following steps: providing a sheet-metal part, and reshaping the sheet-metal part in a stamping and bending process in such a way that the busbar having one or more frame parts integrally formed thereon having the respective conductor passage opening is generated, wherein, in said stamping and bending process, the at least one wing on the side web or the wings on the side webs are formed at the same time.

This can also realize the advantages mentioned above. In particular, the spring terminal contact can be produced in a particularly efficient and cost-effective manner, since only one sheet-metal part is required, which can be provided in a single stamping and bending process with the desired frame parts and the wings arranged thereon. The stamping and bending process can be performed, for example, in such a way that the contour of the busbar with the frame parts and wings arranged thereon is stamped out from a flat, substantially planar sheet-metal part in such a way that the frame parts have the corresponding intermediate spaces between adjacent frame parts and the corresponding conductor passage openings are formed. The required bending steps can then be performed, wherein either first of all the wings are bent at the respective side webs and then the frame parts are bent with respect to the busbar, or, conversely, first of all the frame parts are bent with respect to the busbar and then the wings are bent at the side webs.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
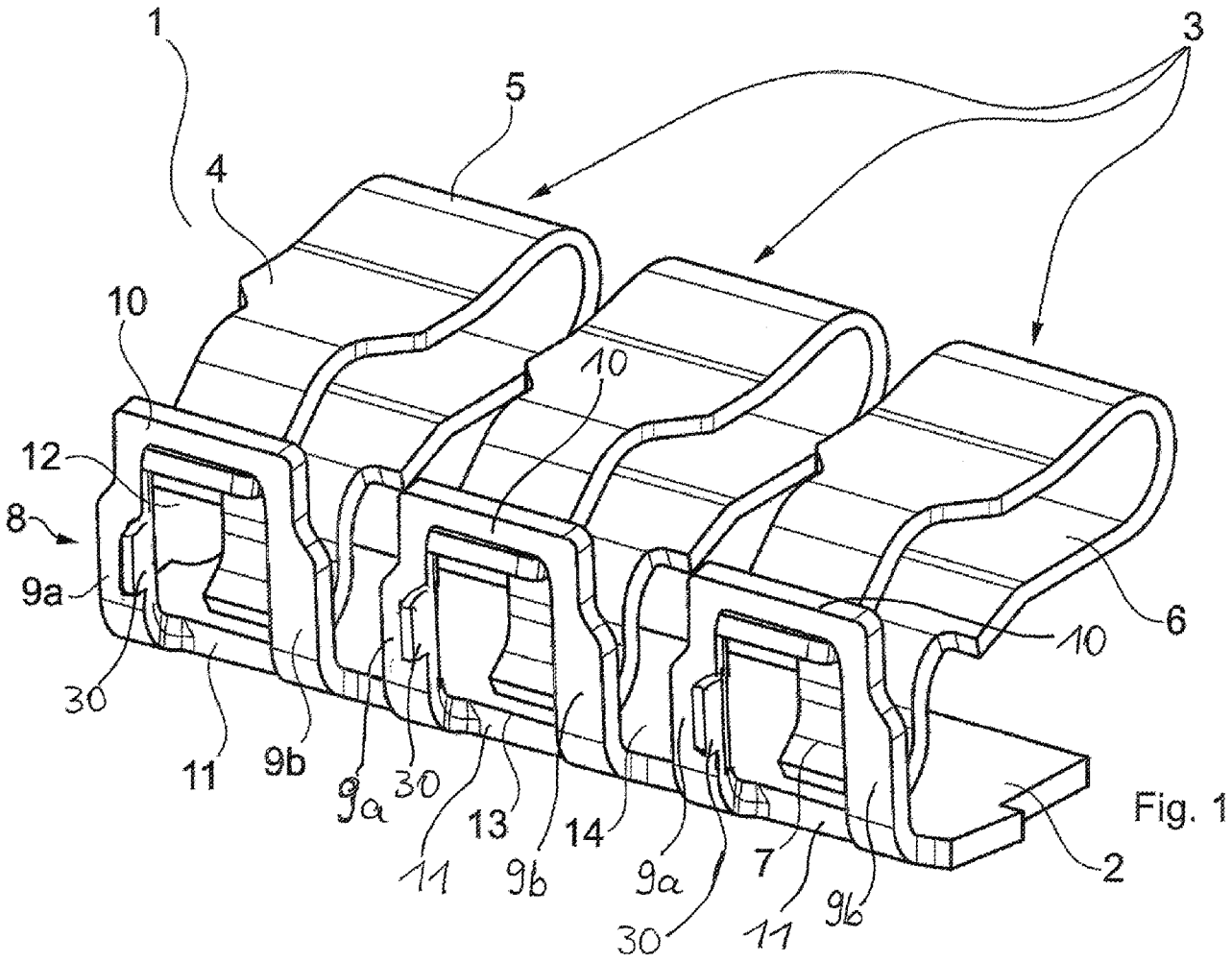
FIG. 1 shows a perspective view of a spring terminal contact having a busbar and three clamping springs arranged next to one another.

FIG. 1 shows a perspective view of a spring terminal contact 1, which is substantially formed of a busbar 2 and a plurality of clamping springs 3, for example three as is illustrated. The busbar 2 is formed from a material having good electrical conductivity, such as, for example, copper sheet metal. It extends transversely to the direction of extent of the clamping springs 3 and in the modular mounting direction of the plurality of clamping springs 3. In this way, the electrical conductor clamped to a clamping point of the busbar 2 using a clamping spring 3 can then be electrically conductively connected to a further electrical conductor clamped to another clamping spring 3 of the spring terminal contact 1.

The clamping springs 3 each have a resting limb 4, a spring bed 5 adjoining the resting limb 4 and a clamping limb 6 adjoining the spring bend 5. The clamping limbs 6 each have a clamping section 7 at the free end at which a clamping edge is formed. For each clamping spring 3, associated frame parts 8 are shaped with the busbar 2, said frame parts each having two side webs 9*a*, 9*b* spaced apart from one another and an upper transverse web 10 connecting the side webs 9*a*, 9*b* to one another at the free end. The transversely running busbar 2 forms a further lower transverse web 11 opposite the upper transverse web 10. A conductor passage opening 12 for guiding an electrical conductor is provided by the side webs 9*a*, 9*b* and the transverse webs 10, 11 lying opposite one another, said electrical conductor being clamped to the clamping edge of the clamping section 7 of the associated clamping spring 3 and the contact edge 13 formed at the lower transverse web 11 of the busbar 2. The clamping edge of the clamping section 7 of the clamping spring 3 and the contact edge 13 of the busbar 2 thus form a clamping point for the electrical conductor to be clamped.

It becomes clear that the frame parts 8 for the clamping springs 3 arranged next to one another are spaced apart from one another to form an intermediate space 14 between frame parts 8 arranged next to one another. The adjacent side webs 9*a*, 9*b* of the frame parts 8 lying next to one another have a spacing from one another. A section of an actuation element can be introduced into this intermediate space 14 for at least one associated clamping spring 3, with the result that the space between the clamping springs 3 and, in particular, the space between the frame parts 8 can be used by the intermediate space 14 to receive sections of an actuation lever. A very compact connecting terminal can therefore be constructed.

A wing 30 is present on the respective side web 9*a* of each of the frame parts 8, said wing being able to improve the electrical contact-connection of litz-wire conductors.

It can furthermore be seen that the clamping section 7 of the clamping spring 3 has a smaller width than the adjoining further section of the clamping limb 6 and of the spring bend 5. A region of the clamping limb 6 that protrudes laterally relative to the clamping section 7 is therefore present, on which an actuation contour of an actuation lever can act, wherein the actuation contour is arranged on a side wall section of an actuation lever that protrudes into the intermediate space 14 at least in the closed state. The axis of rotation of said actuation lever (not illustrated) is then located below the clamping limb 6 and the spring bend 5 in the intermediate space between the clamping limb 6 and the busbar 2.

It can furthermore be seen that the free end of the resting limb 4 likewise has a smaller width than the section of the resting limb 4 adjoining the spring bend 5 and of the spring bend 5. This reduced width of the resting limb 4 is matched to the width of the conductor passage opening 12 of the frame part 8, in order to make it possible for the resting limb 4 to hook into the conductor passage opening 2 for resting on the upper transverse web 10.

Figure 2:
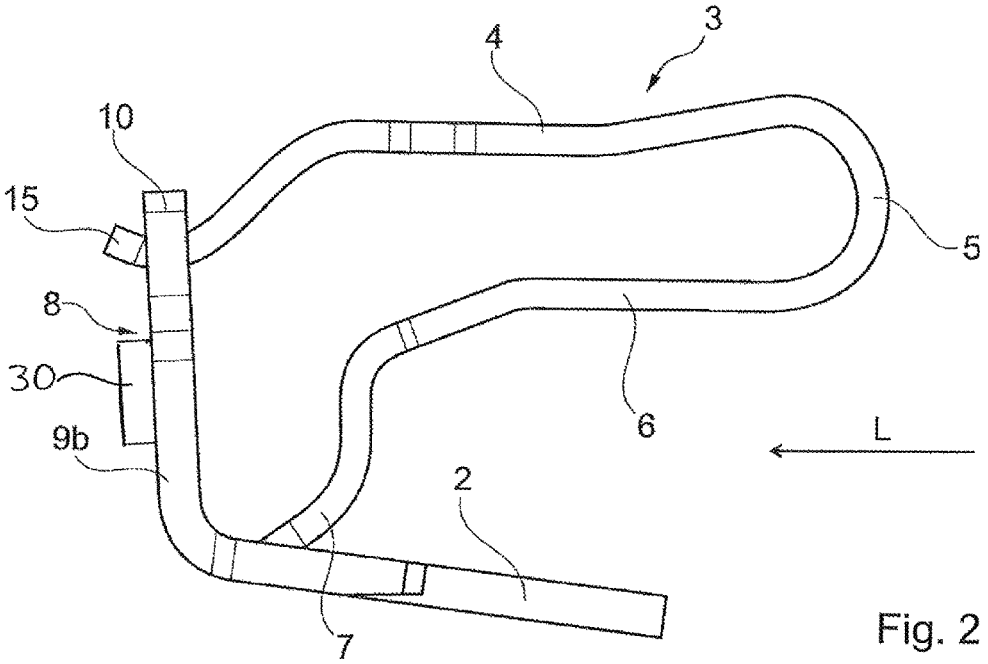
FIG. 2 shows a side view of the spring terminal contact from FIG. 1.

FIG. 2 shows a side view of the spring terminal contact 1 from FIG. 1. It becomes clear here that the rear free end of the resting limb 4 protrudes through the conductor passage opening 12 of the frame part 8 and is hooked into the frame part 8. It can furthermore be seen that the frame part 8 is shaped integrally with the busbar 2 from the same sheet-metal part and is bent from the plane of the busbar bordering the clamping edge of the clamping spring 3 in the direction of the resting limb 4 of the clamping spring 3 at an angle of approximately 90° to 120°.

It can furthermore be seen that the clamping limb 6 is at an internal angle of approximately 70° to 120° in the direction of the plane of the busbar 2 on which the clamping edge of the clamping section 7 bears in the illustrated rest state, is bent and is virtually (+/−20%) perpendicular to this plane. The clamping section 7 is then bent back again from said heavily bent section transverse to the conductor insertion direction toward the free end in order to form a clamping edge and is at an acute angle to the aforementioned plane of the busbar 2. In this way, direct clamping of a multi-wire, electrical conductor inserted in the conductor insertion direction L can be prevented without prior opening of the clamping point by displacing the clamping limb 6 upward in the direction of the resting limb 4. This kind of direct insertion of a multi-wire, electrical conductor without prior actuation could lead to splitting of the plurality of wires of the electrical conductor, which are then located in the terminal space uncontrolled.

Figure 3:
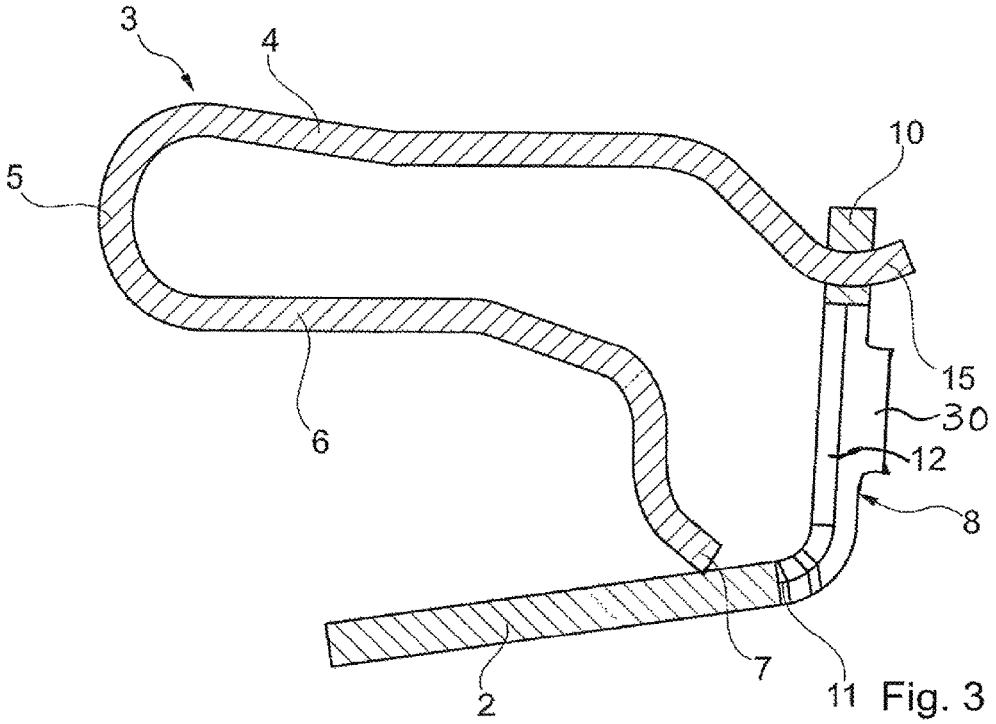
FIG. 3 shows a sectional side view of the spring terminal contact from FIG. 1.

FIG. 3 shows a sectional side view through the first embodiment of the spring terminal contact from FIGS. 1 and 2. It becomes clear here that the resting limb 4 is guided through the conductor passage opening 12 using a bent end section 15 and bears against the upper transverse web 10. The clamping spring 3 is therefore hooked into the busbar 2 in a positionally stable manner. The opposite end of the clamping spring 3 bent in a U-shaped manner, that is to say the clamping section 7 of the clamping limb 4, is bent in the direction of the section of the busbar 2 extending transversely to the number of clamping springs 3, which borders the frame parts 8, wherein the free end of the clamping section is at an acute angle to said transversely running section of the busbar 2. An adjoining section of the clamping limb 6 approximately transverse to the conductor insertion direction L and the section of the busbar 2 is, in contrast, oriented at an obtuse angle to the transversely running section of the busbar 2, in order to prevent direct insertion of a multi-wire, electrical conductor without prior actuation of the clamping spring 3.

Figure 4:
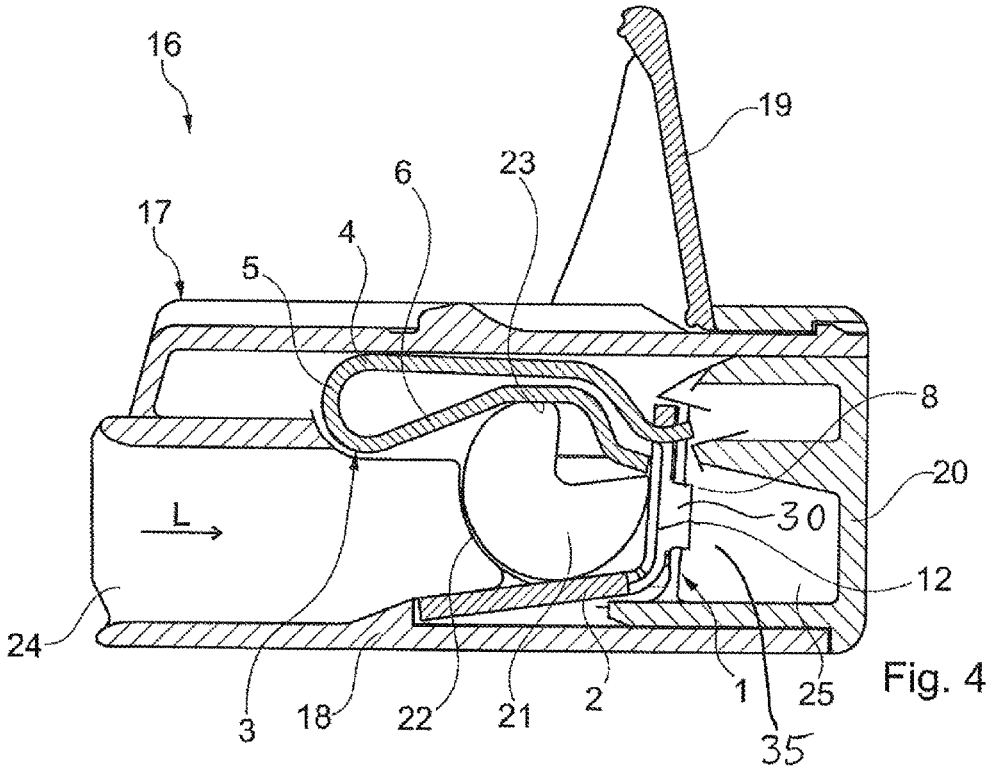
FIG. 4 shows a sectional side view through a connecting terminal having an isolating material housing, in this case having an actuation lever for an associated clamping spring and having a spring terminal contact built into the isolating material housing from FIG. 1 with an open actuation lever.

FIG. 4 shows a cross-sectional view of a connecting terminal 16 having an isolating material housing 17. The isolating material housing 17 is embodied in two parts and has a main housing part 18 formed from isolating material, which is sealed with a cover part 20 after introduction of an actuation lever 19 and the spring terminal contact 1. The main housing part 18 and the cover part 20 are latched to one another here in order to thus mount the actuation lever 19 with a pivot bearing section 21 in the isolating material housing 17, said pivot bearing section having a pitch-circle shaped periphery, on said pitch-circle shaped periphery that has pitch-circle shaped mounting contours 22 adapted to said pitch-circle shaped periphery. In this case, the pivot bearing section 21 can also be mounted on the busbar 2.

It becomes clear that the pivot bearing section 21 has an actuation contour 23 in the form of a V-shaped cut-out, which passes over a curved track in the outer periphery. A lateral region of the clamping limb 6 of the associated clamping spring 3 in this case lies on said actuation contour 23, with the result that, in the open position of the actuation lever 19 that is illustrated, the clamping limb 6 is displaced away from the transversely running section of the busbar 2.

An electrical conductor can then be inserted by means of a conductor insertion opening 24 in the isolating material housing 17, the end side of which is open and opens into the connection space of the spring terminal contact 1. Said electrical conductor is then guided through the conductor passage opening 12 of the associated frame part 8 of the spring terminal contact 1 by means of the section of the busbar 2, which runs in an inclined manner and extends transversely to the clamping springs 3. The free stripped end of an electrical conductor then reaches a conductor receiving pocket 25 located in the conductor receiving space 35, said conductor receiving pocket lying behind the conductor passage opening 12 of the frame part 8, as seen in the conductor guiding direction L, that is to say in the direction of extent of the conductor insertion opening 24.

Figure 5:
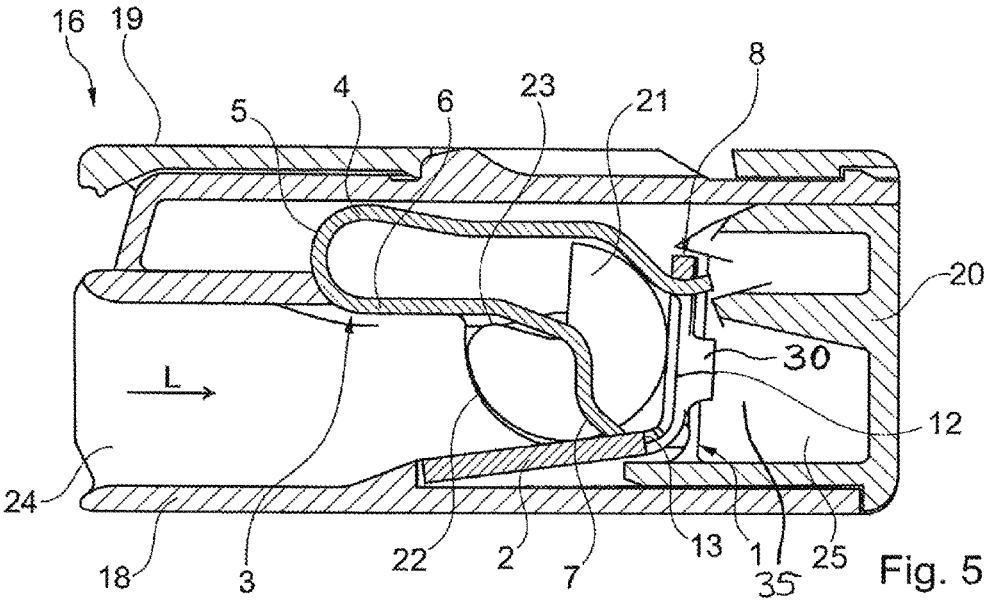
FIG. 5 shows a sectional side view through the connecting terminal from FIG. 4 with a closed actuation lever.

FIG. 5 shows the connecting terminal 16 from FIG. 4 in the closed state. In this case, the actuation lever 19 is lowered downward in the direction of the isolation material housing 17. Here, the actuation contour 23 has been rotated by the pivot bearing section 21 pivoting by approximately 90°. Here, it is made possible for the clamping limb 6 to be displaced away from the resting limb 4 downward in the direction of the busbar 2 by the force of the clamping spring 3. In the closed end position that is illustrated, the clamping limb 6 no longer lies on the actuation contour 23, with the result that the clamping spring 3 can be moved by the actuation lever 19 unimpeded. An electrical conductor (not illustrated) inserted into the conductor insertion opening 24 is thereby electrically conductively and mechanically firmly clamped to the clamping edge on the free clamping section 7 and the contact edge 13 on the busbar 2 by the force of the clamping spring 3, with the result that an electrical current can be guided to an adjacent clamping contact by means of the electrical conductor and the busbar 2.

In accordance with FIGS. 1 to 5, the frame parts 8 are each configured so that a wing 30 is present at only the one side web 9*a*. As mentioned, wings of this kind can be present on the two side webs 9*a*, 9*b*, as is explained below with reference to the further FIGS. 6 to 10. For the sake of better clarity of the details in connection with the wings 30, the spring terminal contacts are illustrated in these figures without the clamping springs. The clamping section 7 is only partly illustrated in FIG. 9.

Figure 6:
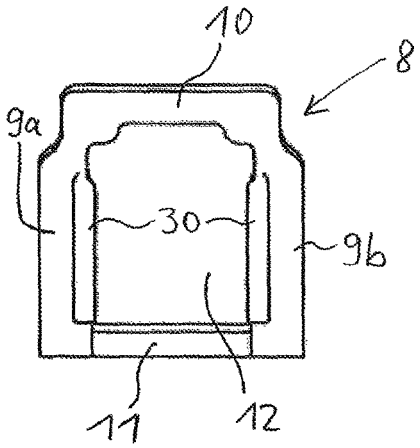
FIG. 6 shows a front view of a frame part.
Figure 7:
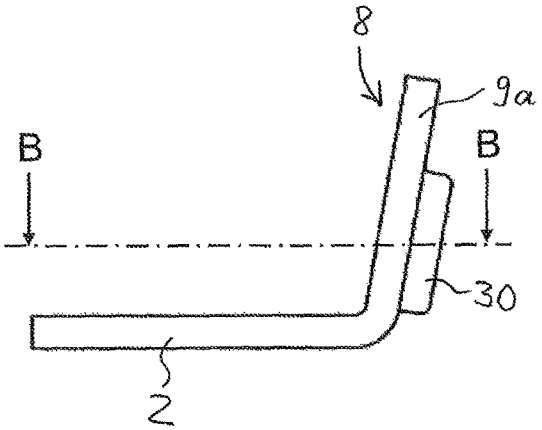
FIG. 7 shows a side view of the frame part in accordance with FIG. 6 and the busbar
Figure 8:
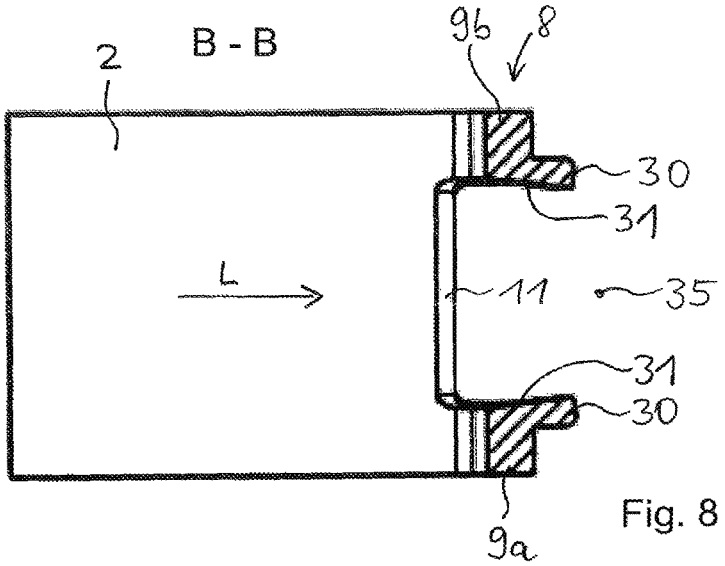
FIG. 8 shows a cross-sectional view of the frame part having the busbar in accordance with FIG. 7 corresponding to the sectional plane B-B.

As FIGS. 6 to 8 show, the mentioned wings 30 can in each case be arranged on the two side webs 9*a*, 9*b* of a frame part 8. They can be arranged, in particular, symmetrically to one another, with the result that the intermediate space between the wings 30 is tapered in the conductor insertion direction L. It can be seen in particular in FIG. 8 that the wings 30 provide a significantly increased resting surface 31 for the litz wires of an electrical litz-wire conductor.

Figure 9:
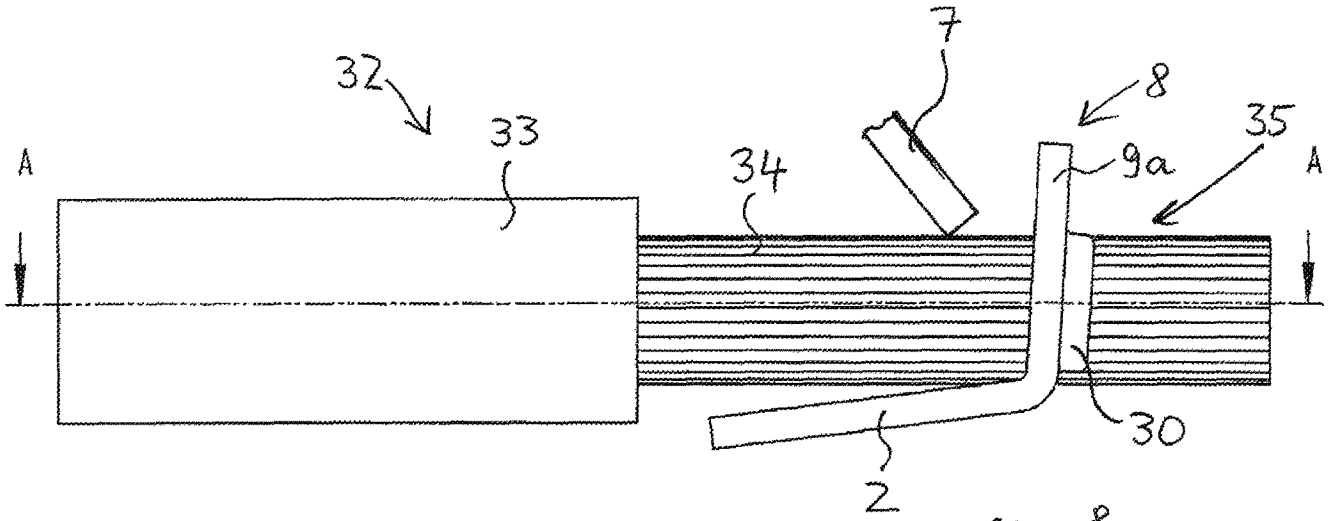
FIG. 9 shows a view of the frame part having the busbar corresponding to FIG. 7 having an inserted electrical conductor.
Figure 10:
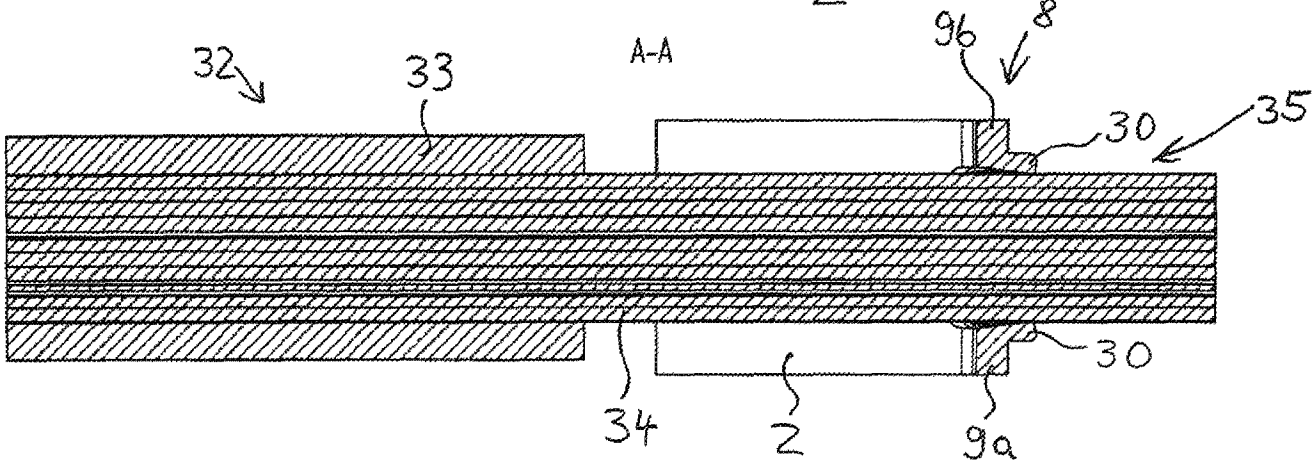
FIG. 10 shows a sectional view in accordance with the sectional plane A-A illustrated in FIG. 9.

FIGS. 9 and 10 show the spring terminal contact when using an electrical conductor in the form of a litz-wire conductor 32. The litz-wire conductor 32 has an outer insulation 33 and litz-wires 34 arranged therein. With a stripped region of the litz-wire conductor 32, the latter is used in the spring terminal contact by virtue of the clamping limb 7 of the clamping spring pressing on the litz wires 34 from above and pressing them against the busbar 2. The relatively flexible litz wires 34 give in slightly to this pressure and move slightly to the side, with the result that they are pressed to a greater extent against the resting surfaces 31 of the wings 30. This can be seen in FIG. 10, in particular, where it is clear that the sides of the individual litz wires 34 cling to the wings 30. This improves the electrical contact-connection of the litz wires 34 to the busbar 2.

FIGS. 11 to 14 show the frame part 8 and the busbar 2 of a spring terminal contact of a further embodiment. To illustrate the features, the clamping spring is not illustrated in this case but it is described in more detail below. The clamping spring can be embodied, for example, in a similar manner to that seen in FIG. 2.

Figure 12:
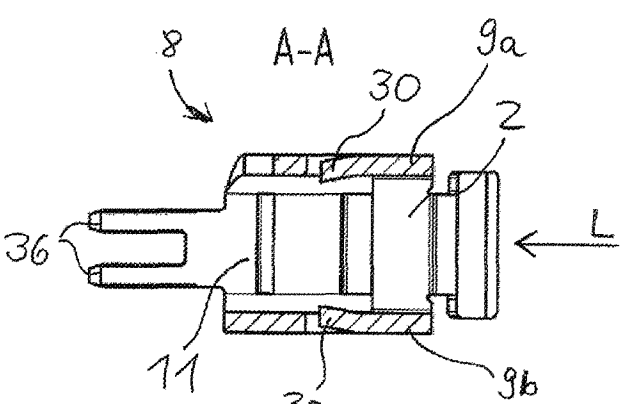
FIGS. 11 to 14 show different views of a part of an embodiment of a spring terminal contact.
Figure 11:
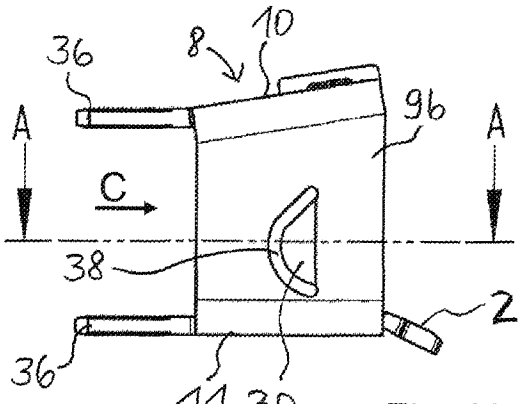
Figure 14:
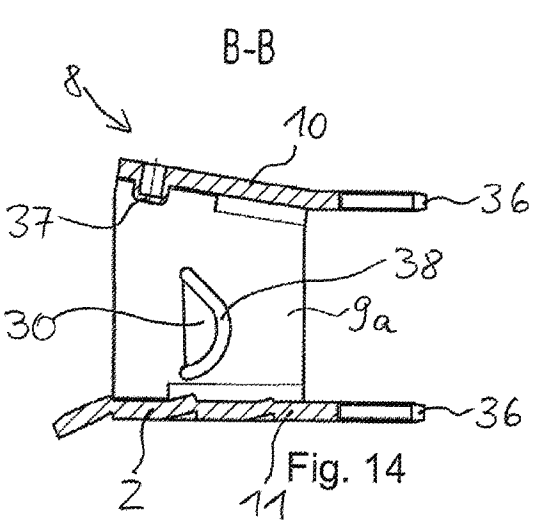
Figure 13:
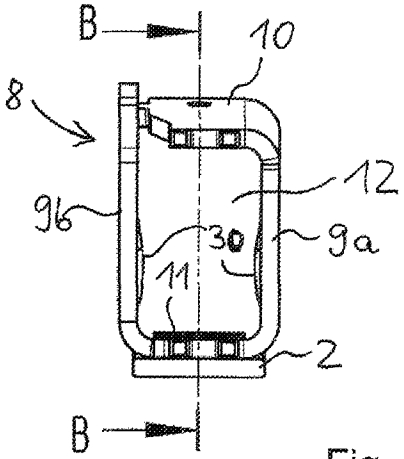

FIG. 11 shows a side view of the illustrated component, FIG. 12 shows a view corresponding to the viewing direction C illustrated in FIG. 11, FIG. 13 shows a sectional illustration of the component corresponding to the sectional plane B-B marked in FIG. 12 and FIG. 14 shows a sectional illustration of the component in accordance with the sectional plane A-A marked in FIG. 11.

As can be seen in FIGS. 11 to 14, the illustrated component has a frame part 8 that is formed integrally with the busbar 2, wherein a part of the busbar can in this case form, in particular, the lower transverse web 11. A frame part 8 is in turn formed together with the side webs 9*a*, 9*b* and the upper transverse web 10, by which a conductor passage opening 12 is enclosed. Protruding electrical connection contacts 36, for example in the form of contact pins, which can be soldered into a printed circuit board, can be arranged on the frame part 8. The frame part 8 has in each case an integrally formed wing 30 formed in each of the side webs 9*a*, 9*b*. Said wing can be exposed by introducing a slot 38 in the respective side web 9*a*, 9*b* opposite the plane of the respective side web 9*a*, 9*b*, in particular toward the interior space of the frame part 8, in which the conductor passage opening 12 is formed. As FIG. 12, in particular, shows, the inwardly presented wing 30 forms a funnel-shaped conductor insertion aid for an electrical conductor inserted in the conductor insertion direction L.

As can be seen, the respective wing 30 is formed in the inner region of a respective side web 9*a*, 9*b*, with the result that a slot 38 that is completely enclosed by the material of the respective side web 9*a*, 9*b* is present.

The clamping section of the clamping spring (not illustrated in FIGS. 11 to 14) can rest on the busbar 2 when no conductor is inserted. To secure the clamping spring to the frame part 8, a holding lug 37, for example in the form of an indentation in the material of the frame part 8, that protrudes toward the inner space of the frame part 8 is formed on the upper transverse web 10. The clamping spring can be hooked onto the holding lug 37 using a correspondingly matched opening or drilled hole in the resting limb and is thereby fixed to the frame part 8.

Figure 16:
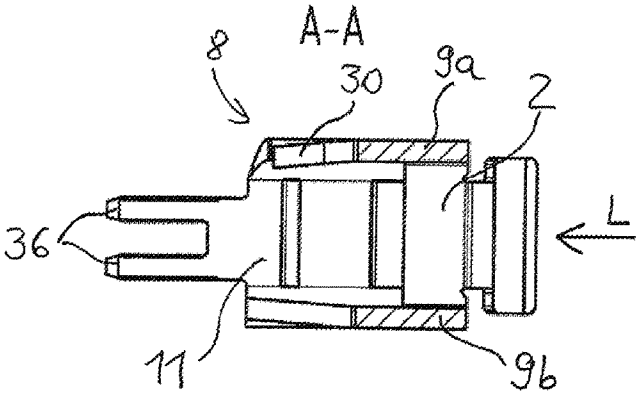
FIGS. 15 to 18 show different views of a part of an embodiment of a spring terminal contact.
Figure 18:
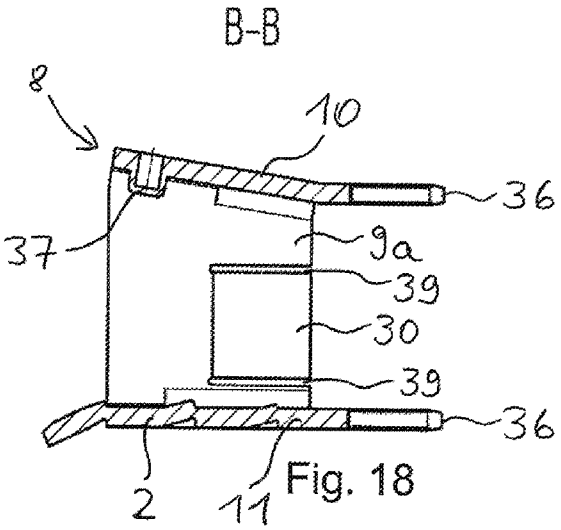
Figure 15:
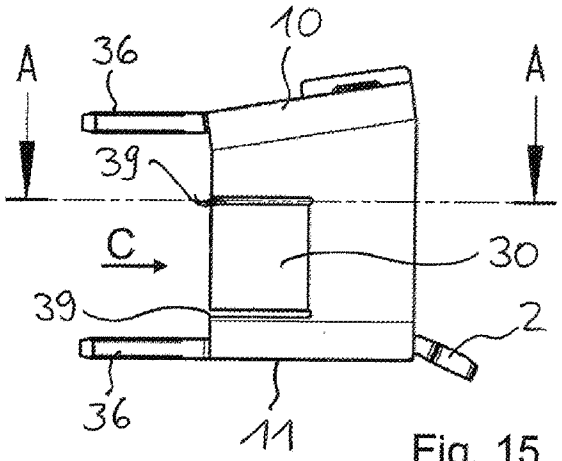
Figure 17:
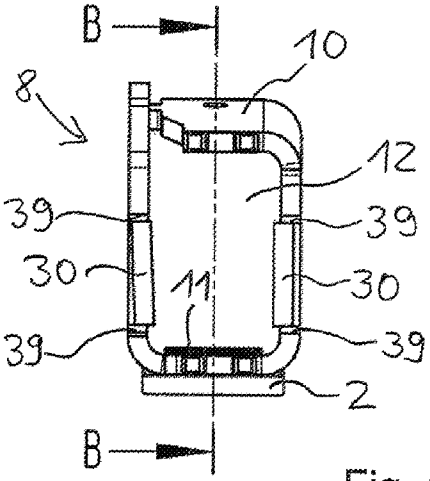

FIGS. 15 to 18 show a further embodiment of a component of this kind having a frame part 8 and a busbar 2 integrally formed therewith in comparable illustrations to FIGS. 11 to 14. FIG. 15 shows a side view of the illustrated component, FIG. 16 shows a view corresponding to the viewing direction C illustrated in FIG. 15, FIG. 17 shows a sectional illustration of the component corresponding to the sectional plane B-B marked in FIG. 16 and FIG. 18 shows a sectional illustration of the component in accordance with the sectional plane A-A marked in FIG. 15.

In contrast to the embodiment of FIGS. 11 to 14, the respective wing 30 is not formed in the inner space of a respective side web 9*a*, 9*b*. Instead, each of the side webs 9*a*, 9*b* is, starting from an end region of the respective side web 9*a*, 9*b*, separated from the material of the respective side web by a longitudinal slot 39 inserted in the longitudinal direction, that is to say in the conductor insertion direction L, with the result that the respective wing 30 can again be presented toward the inner space of the frame part 8, as is illustrated in FIG. 16, for example.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A spring terminal contact for contact-connection of electrical conductors, the spring terminal contact comprising:

at least one busbar;

at least one clamping spring that has a resting limb, a spring bend adjoining the resting limb, and a clamping limb adjoining the spring bend, the clamping limb having a clamping section at a free end;

at least one frame part extending away from the at least one busbar, the at least one frame part having two side webs spaced apart from one another, the side webs having transverse webs connecting to one another and a conductor passage opening formed by the side webs and the transverse webs; and at least one integrally formed wing arranged on at least one of the side webs, wherein the at least one clamping spring is secured to the at least one busbar by the resting limb of the at least one clamping spring resting on a transverse web and/or a holding element of the at least one busbar such that the clamping section acts under a spring force of the at least one clamping spring in a direction of the at least one busbar such that a clamping point for firmly clamping the electrical conductor is formed between the clamping section and the at least one busbar, and wherein the two side webs extend directly from a same side edge of the at least one busbar, such that the two side webs extend in a same plane.

2. The spring terminal contact according to claim 1, wherein the at least one integrally formed wing includes a first integrally formed wing and a second integrally formed wing, the first integrally formed wing being arranged on a first one of the two side webs of the at least one frame part and the second integrally formed wing being arranged on a second one of the two side webs of the at least one frame part.

3. The spring terminal contact according to claim 2, wherein the first and second integrally formed wings of the at least one frame part are arranged substantially symmetrically to one another.

4. The spring terminal contact according to claim 1, wherein the at least one integrally formed wing points in a direction of a conductor receiving space of the spring terminal contact, the conductor receiving space being formed behind the conductor passage opening in a conductor insertion direction.

5. The spring terminal contact according to claim 1, wherein the at least one integrally formed wing is configured as a material region that is angled with respect to a surface of the at least one of the side webs.

6. The spring terminal contact according to claim 1, wherein the at least one integrally formed wing extends along the at least one of the side webs over at least two thirds of a distance between the transverse webs of the at least one frame part.

7. The spring terminal contact according to claim 1, wherein a lead-in chamfer for the electrical conductor to be inserted is formed by the at least one integrally formed wing.

8. The spring terminal contact according to claim 1, wherein the at least one frame part is arranged substantially at a right angle to the at least one busbar.

9. The spring terminal contact according to claim 1, wherein the at least one frame part is formed integrally with the at least one busbar.

10. The spring terminal contact according to claim 1, wherein a plurality of the at least one frame part is provided, at least one frame part of the plurality of the at least one frame part is configured as a frame element that is separate from the at least one busbar and is hooked into the at least one busbar.

11. The spring terminal contact according to claim 1, wherein the clamping section is turned away or bent from a section of the clamping limb adjoining the spring bend in a direction of the at least one busbar.

12. The spring terminal contact according to claim 1, wherein the clamping section has a smaller width than another section of the clamping limb.

13. The spring terminal contact according to claim 12, wherein at least one region of the section of the clamping limb that is wider with respect to the clamping section and that protrudes laterally relative to the clamping section is provided as an actuation section for opening a clamping point for an electrical conductor, and wherein the clamping point is formed between the clamping section of the clamping limb and the at least one busbar by way of an actuation element that interacts with the actuation section.

14. The spring terminal contact according to claim 1, wherein a plurality of the at least one frame part is provided and wherein adjacent frame parts of the plurality of the at least one frame part have an intermediate space therebetween.

15. A conductor connection terminal for electrical conductors, comprising:

an insulating material housing; and at least one of the spring terminal contact according to claim 1.

16. A method for producing a spring terminal contact according to claim 1, the method comprising:

providing a sheet-metal part; and reshaping the sheet-metal part in a stamping and bending process such that the at least one busbar has one or more of the at least one frame part integrally formed thereon having a respective conductor passage opening generated, wherein, in said stamping and bending process, the at least one integrally formed wing on the side web is formed at the same time, and wherein the two side webs are formed to extend directly from a same side edge of the at least one busbar, such that the two side webs extend in a same plane.

17. The spring terminal contact according to claim 1, wherein a bent edge section is provided at a free end of the resting limb, and wherein the bent edge section is inserted through the conductor passage opening and hooks onto one of the transverse webs.

18. The spring terminal contact according to claim 1, wherein the transverse webs include a lower transverse web and an upper transverse web, the upper transverse web directly contacting the resting limb of the at least one clamping spring, wherein a first end of the upper transverse web directly connects with a first one of the two side webs and a second end of the upper transverse web directly connects with a second one of the two side webs, and wherein a first end of the lower transverse web directly connects with the first one of the two side webs and a second end of the lower transverse web directly connects with the second one of the two side webs.

19. The spring terminal contact according to claim 1, wherein the at least one wing protrudes from the at least one frame part in a direction away from the spring bend, such that, in a conductor insertion direction, the at least one wing is provided at a front of the at least one frame part while the spring bend is positioned behind the at least one frame part.

20. A spring terminal contact for contact-connection of electrical conductors, the spring terminal contact comprising:

at least one busbar;

at least one clamping spring that has a resting limb, a spring bend adjoining the resting limb, and a clamping limb adjoining the spring bend, the clamping limb having a clamping section at a free end;

at least one frame part extending away from the at least one busbar, the at least one frame part having two side webs spaced apart from one another, the side webs having transverse webs connecting to one another and a conductor passage opening formed by the side webs and the transverse webs; and at least one integrally formed wing arranged on at least one of the side webs, wherein the at least one clamping spring is secured to the at least one busbar by the resting limb of the at least one clamping spring resting on a transverse web and/or a holding element of the at least one busbar such that the clamping section acts under a spring force of the at least one clamping spring in a direction of the at least one busbar such that a clamping point for firmly clamping the electrical conductor is formed between the clamping section and the at least one busbar, and wherein the at least one integrally formed wing is angled relative to the at least one of the side webs on which the at least one integrally formed wing is arranged, such that the at least one integrally formed wing is bent away from the at least one of the side webs.

21. A spring terminal contact for contact-connection of electrical conductors, the spring terminal contact comprising:

at least one busbar;

at least one clamping spring that has a resting limb, a spring bend adjoining the resting limb, and a clamping limb adjoining the spring bend, the clamping limb having a clamping section at a free end;

at least one frame part extending away from the at least one busbar, the at least one frame part having two side webs spaced apart from one another, the side webs having transverse webs connecting to one another and a conductor passage opening formed by the side webs and the transverse webs; and at least one integrally formed wing arranged on at least one of the side webs, wherein the at least one clamping spring is secured to the at least one busbar by the resting limb of the at least one clamping spring resting on a transverse web and/or a holding element of the at least one busbar such that the clamping section acts under a spring force of the at least one clamping spring in a direction of the at least one busbar such that a clamping point for firmly clamping the electrical conductor is formed between the clamping section and the at least one busbar, and wherein the at least one integrally formed wing points in a direction of a conductor receiving space of the spring terminal contact, the conductor receiving space being formed behind the conductor passage opening in a conductor insertion direction.

* * * * *